US007752777B2

(12) United States Patent
Hsieh

(10) Patent No.: US 7,752,777 B2
(45) Date of Patent: Jul. 13, 2010

(54) SHOE SOLE HAVING REINFORCED STRENGTH

(76) Inventor: Chin-Long Hsieh, 5F-1, No. 172, Wuquan 8th St., Xi District, Taichung (TW)

( * ) Notice: Subject to any disclaimer, the term of this patent is extended or adjusted under 35 U.S.C. 154(b) by 753 days.

(21) Appl. No.: 11/702,934

(22) Filed: Feb. 6, 2007

(65) Prior Publication Data

US 2008/0184601 A1 Aug. 7, 2008

(51) Int. Cl.
*A43B 5/00* (2006.01)

(52) U.S. Cl. ..... 36/131; 36/102

(58) Field of Classification Search ..... 36/131, 36/102, 103, 25 R, 31, 36 A, 129
See application file for complete search history.

(56) References Cited

U.S. PATENT DOCUMENTS 4,231,169 A * 11/1980 Toyama et al. ..... 36/43
5,401,564 A * 3/1995 Lee et al. ..... 442/210
6,944,972 B2 * 9/2005 Schmid ..... 36/27
7,016,867 B2 * 3/2006 Lyden ..... 705/26
7,406,781 B2 * 8/2008 Scholz ..... 36/67 D
2003/0051372 A1 * 3/2003 Lyden ..... 36/27
2006/0283045 A1 * 12/2006 Kita et al. ..... 36/28
2007/0107267 A1 * 5/2007 Hodgson ..... 36/129

* cited by examiner

*Primary Examiner*—Jila M Mohandesi

(57) ABSTRACT

A shoe sole includes a sole bottom portion and an enclosure integrally formed on a periphery of the sole bottom portion. The sole bottom portion forms a hard zone that is made of a carbon fiber composite material mixed with a thermosetting epoxy. The enclosure forms a soft zone that is made of a carbon fiber composite material mixed with a thermoplastic polyurethane (TPU). Thus, the shoe sole has a reinforced strength by provision of the enclosure so that the shoe sole is bonded onto the vamp solidly and stably, thereby enhancing the combination strength between the shoe sole and the vamp. In addition, the shoe sole has a light weight and greater hardness by provision of the sole bottom portion, thereby decreasing the weight of the whole shoe.

8 Claims, 4 Drawing Sheets

SHOE SOLE HAVING REINFORCED STRENGTH

BACKGROUND OF THE INVENTION

1. Field of the Invention

The present invention relates to one of a pair of shoes and, more particularly, to one of a pair of racing shoes for a racing bicycle.

2. Description of the Related Art

A conventional racing shoe for a racing bicycle comprises a vamp, and a shoe sole mounted on the bottom of the vamp. The shoe sole is made of a carbon fiber composite material having a light weight and a greater hardness, so that the racing shoe is light and hard so as to satisfy a user's requirement. However, the vamp is made of leather, so that the shoe sole made of a carbon fiber composite material cannot be bonded onto and combined with the vamp easily and conveniently, thereby increasing costs of fabrication.

BRIEF SUMMARY OF THE INVENTION

In accordance with the present invention, there is provided a shoe sole, comprising a sole bottom portion and an enclosure integrally formed on a periphery of the sole bottom portion. The sole bottom portion forms a hard zone that is made of a carbon fiber composite material mixed with a thermosetting epoxy. The enclosure forms a soft zone that is made of a carbon fiber composite material mixed with a thermoplastic polyurethane (TPU).

The primary objective of the present invention is to provide a shoe sole having a reinforced strength.

Another objective of the present invention is to provide a shoe sole, wherein the shoe sole has a reinforced strength by provision of the enclosure so that the shoe sole is bonded onto the vamp solidly and stably, thereby enhancing the combination strength between the shoe sole and the vamp.

A further objective of the present invention is to provide a shoe sole, wherein the shoe sole has a light weight and greater hardness by provision of the sole bottom portion, thereby decreasing the weight of the whole shoe.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
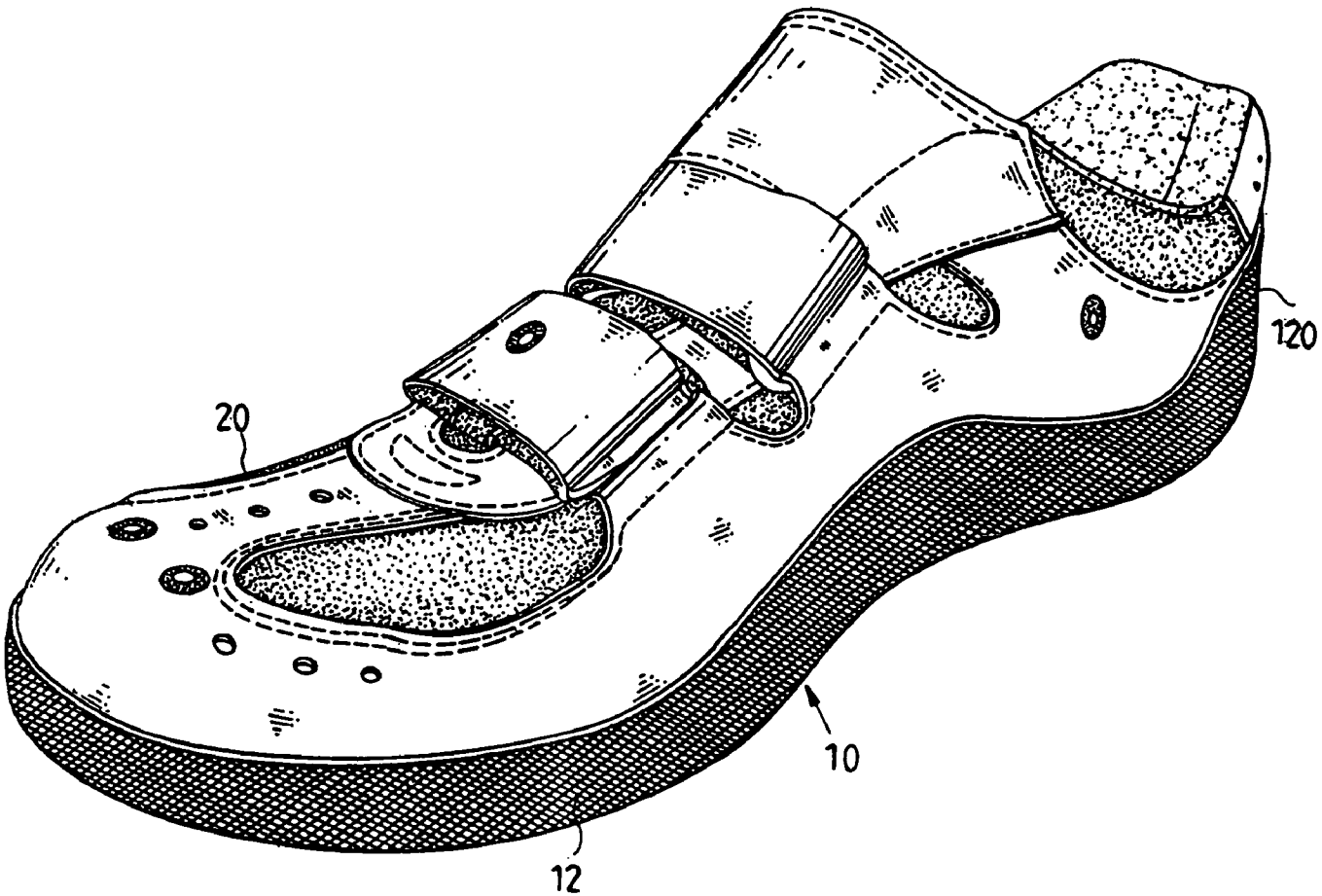
FIG. 1 is a perspective view of one of a pair of shoes in accordance with the preferred embodiment of the present invention.
Figure 2:
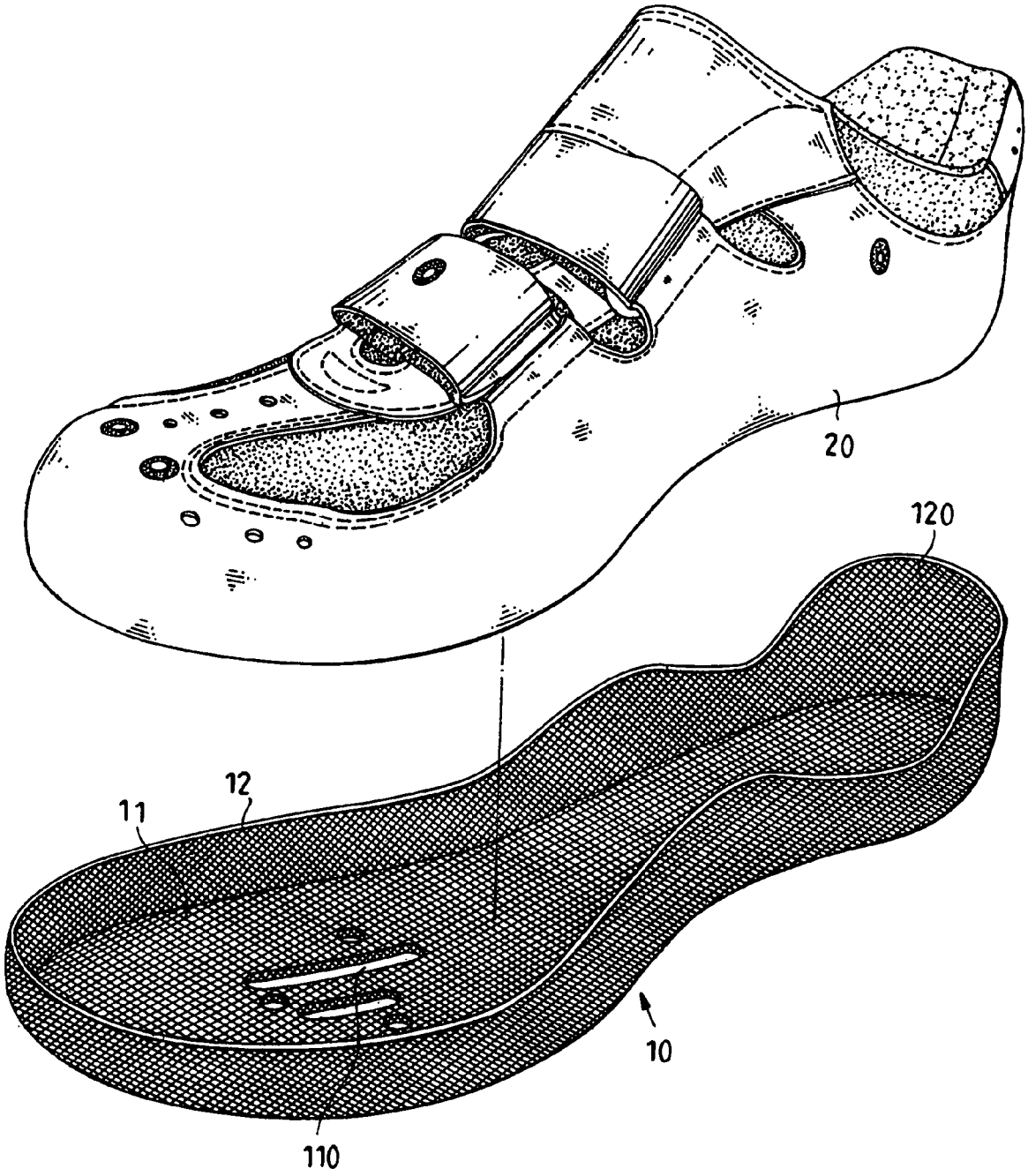
FIG. 2 is an exploded perspective view of the shoes as shown in FIG. 1.
Figure 3:
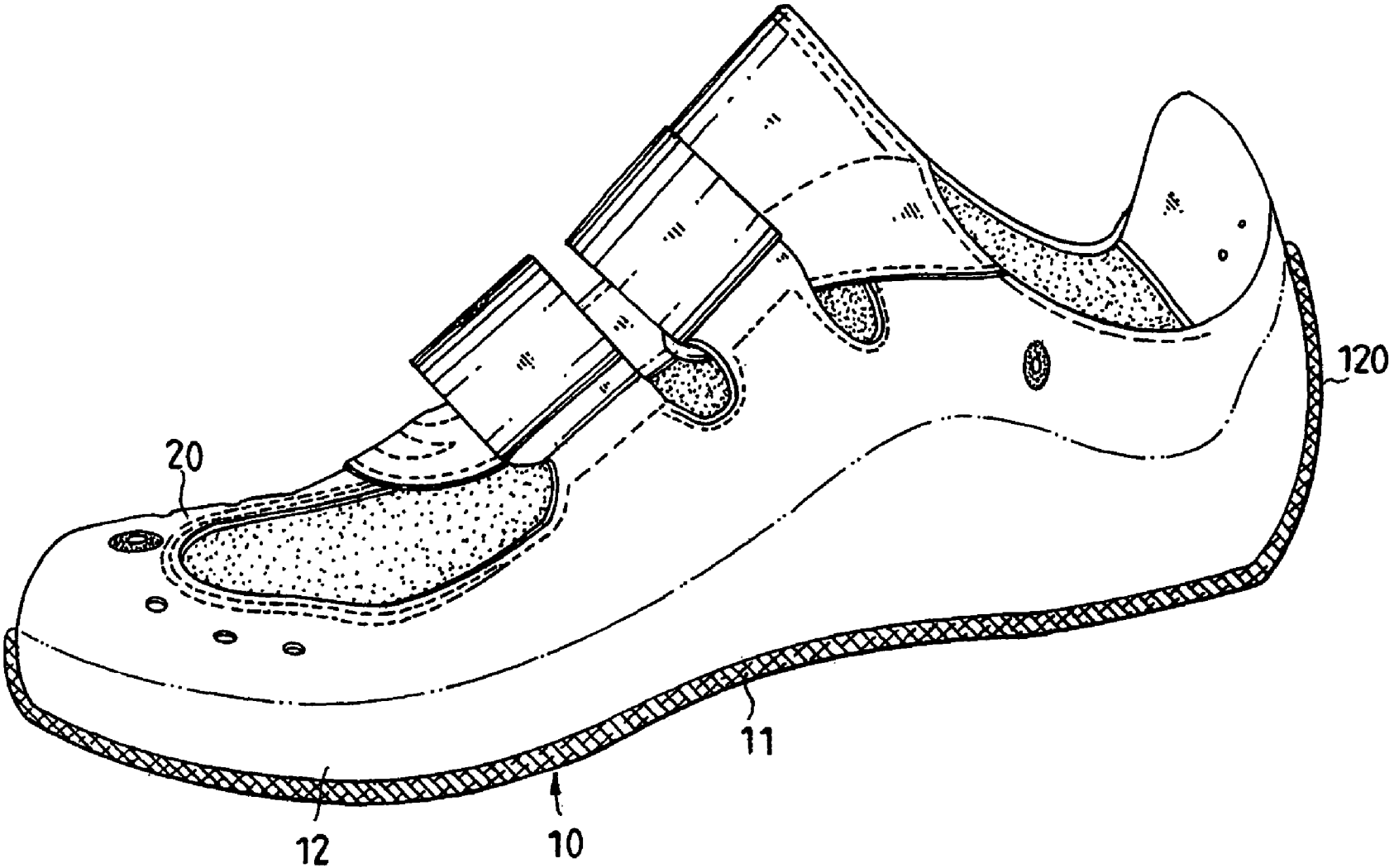
FIG. 3 is a side cross-sectional view of the shoes as shown in FIG. 1.
Figure 5:
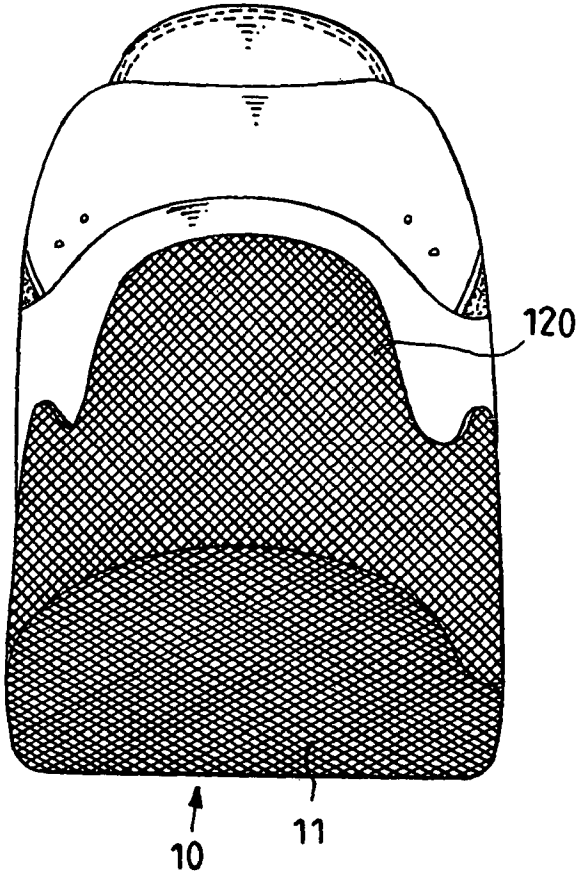
FIG. 5 is a rear view of the shoes as shown in FIG. 1.
Figure 4:
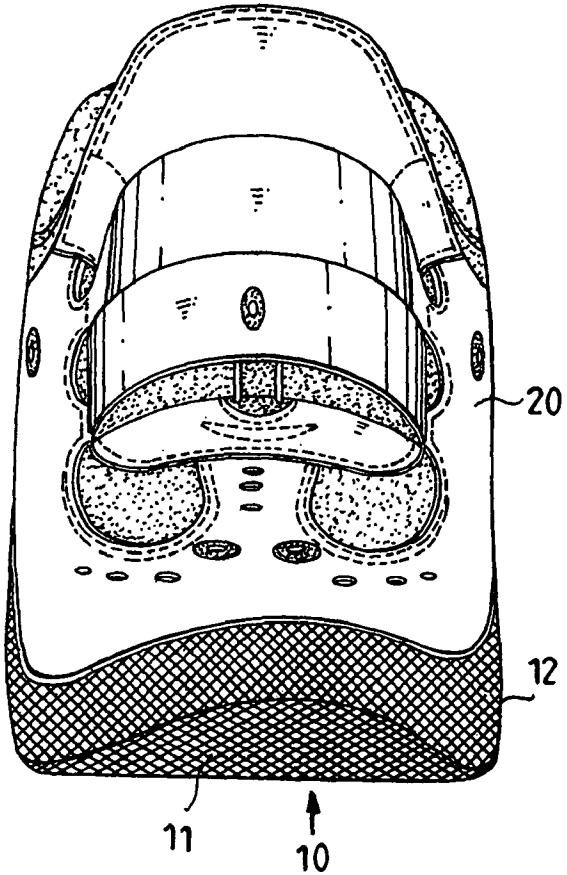
FIG. 4 is a front view of the shoes as shown in FIG. 1.

Referring to the drawings and initially to FIG. 1, one of a pair of shoes in accordance with the preferred embodiment of the present invention comprises a vamp 20, and a shoe sole 10 mounted on the bottom of the vamp 20.

Referring to FIGS. 1-5, the shoe sole 10 is made of a carbon fiber composite material and comprises a sole bottom portion 11 and an enclosure 12 integrally formed on a periphery of the sole bottom portion 11.

The sole bottom portion 11 of the shoe sole 10 forms a hard zone that is made of a carbon fiber composite material mixed with a thermosetting epoxy. The sole bottom portion 11 of the shoe sole 10 has a front portion formed with at least one slot 110 for locking a snapping block (not shown).

The enclosure 12 of the shoe sole 10 has a substantially plate shape and forms a soft zone that is made of a carbon fiber composite material mixed with a thermoplastic polyurethane (TPU). The enclosure 12 of the shoe sole 10 is bendable and stiff to have a determined stiffness. The enclosure 12 extends upward from the periphery of the sole bottom portion 11. The enclosure 12 of the shoe sole 10 has a rear portion formed with a rear protective rim 120 to protect a user's heel. The rear protective rim 120 extends upward from the enclosure 12 of the shoe sole 10 and has a substantially arc-shaped cross-sectional profile.

In such a manner, the shoe sole 10 has a light weight and greater hardness by provision of the sole bottom portion 11. In addition, the shoe sole 10 is stiff and bendable by provision of the enclosure 12, so that the shoe sole 10 has a reinforced strength and is bonded onto the vamp 20 solidly and stably, thereby enhancing the combination strength between the shoe sole 10 and the vamp 20.

Accordingly, the shoe sole 10 has a reinforced strength by provision of the enclosure 12 so that the shoe sole 10 is bonded onto the vamp 20 solidly and stably, thereby enhancing the combination strength between the shoe sole 10 and the vamp 20. In addition, the shoe sole 10 has a light weight and greater hardness by provision of the sole bottom portion 11, thereby decreasing the weight of the whole shoe.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shoe sole, comprising a sole bottom portion and an enclosure integrally formed on a periphery of the sole bottom portion, wherein:

the sole bottom portion forms a single hard zone that is integratedly made of a carbon fiber composite material mixed with a thermosetting epoxy;

the enclosure forms a soft zone that is made of a carbon fiber composite material mixed with a thermoplastic polyurethane (TPU).

2. The shoe sole in accordance with claim 1, wherein the sole bottom portion has a front portion formed with at least one slot.

3. The shoe sole in accordance with claim 1, wherein the enclosure has a rear portion formed with a rear protective rim.

4. The shoe sole in accordance with claim 3, wherein the rear protective rim extends upward from the enclosure.

5. The shoe sole in accordance with claim 3, wherein the rear protective rim has a substantially arc-shaped cross-sectional profile.

6. The shoe sole in accordance with claim 1, wherein the enclosure has a substantially plate shape.

7. The shoe sole in accordance with claim 1, wherein the enclosure is bendable and stiff.

8. The shoe sole in accordance with claim 1, wherein the enclosure extends upward from the periphery of the sole bottom portion.

* * * * *